United States Patent [19]

Litke et al.

[11] 3,991,823

[45] Nov. 16, 1976

[54] MULTI-PASS HEAT EXCHANGER HAVING FINNED CONDUITS OF POLYGONAL CONFIGURATION IN CROSS-SECTION

[75] Inventors: William R. Litke, Franklin Lakes; Richard J. Haberski, Emerson, both of N.J.

[73] Assignee: Curtiss-Wright Corporation, Wood-Ridge, N.J.

[22] Filed: May 29, 1975

[21] Appl. No.: 581,963

[52] U.S. Cl. ..... 165/145; 165/163

[51] Int. Cl.[2] ..... F28D 7/00; F28F 9/22

[58] Field of Search ..... 165/145, 170.4, 181–183; 122/477; 29/157.3 R, 157.3 H, 157.4

[56] References Cited

UNITED STATES PATENTS

| | | | |
|---|---|---|---|
| 1,969,406 | 8/1934 | Kerr | 122/477 X |
| 2,869,834 | 1/1959 | Clark, Jr. et al. | 165/145 X |
| 3,495,657 | 2/1970 | Keith | 165/183 |
| 3,692,105 | 9/1972 | O'Connor | 165/181 |
| 3,805,881 | 4/1974 | Kenrick et al. | 165/145 |

*Primary Examiner*—Charles J. Myhre
*Assistant Examiner*—Theophil W. Streule, Jr.
*Attorney, Agent, or Firm*—Arthur Frederick; Victor D. Behn

[57] ABSTRACT

The multi-pass heat exchanger comprises an open-ended shell for receiving a first fluid and at least one tube bank disposed in the shell and connected to pass a second fluid in indirect heat transfer with the first fluid. The tube bank may comprise one or more conduits each of which are of polygonal configuration in cross-section and have spaced rows of fins extending from the large sized surfaces of the conduits. Each of the conduits is formed into a flattened helical configuration consisting of substantially straight portions so arranged that alternate straight portions extend in substantial parallelism and having return bend portions interconnecting end-to-end next adjacent straight portions so that series flow of second fluid is provided through the straight portions. The tube bank is positioned in the shell with the small sized surfaces extending in planes generally normal to the longitudinal axis of the shell so that the first fluid flows successively past the straight portions and thereby in indirect heat transfer with the second fluid flowing through the conduits.

15 Claims, 9 Drawing Figures

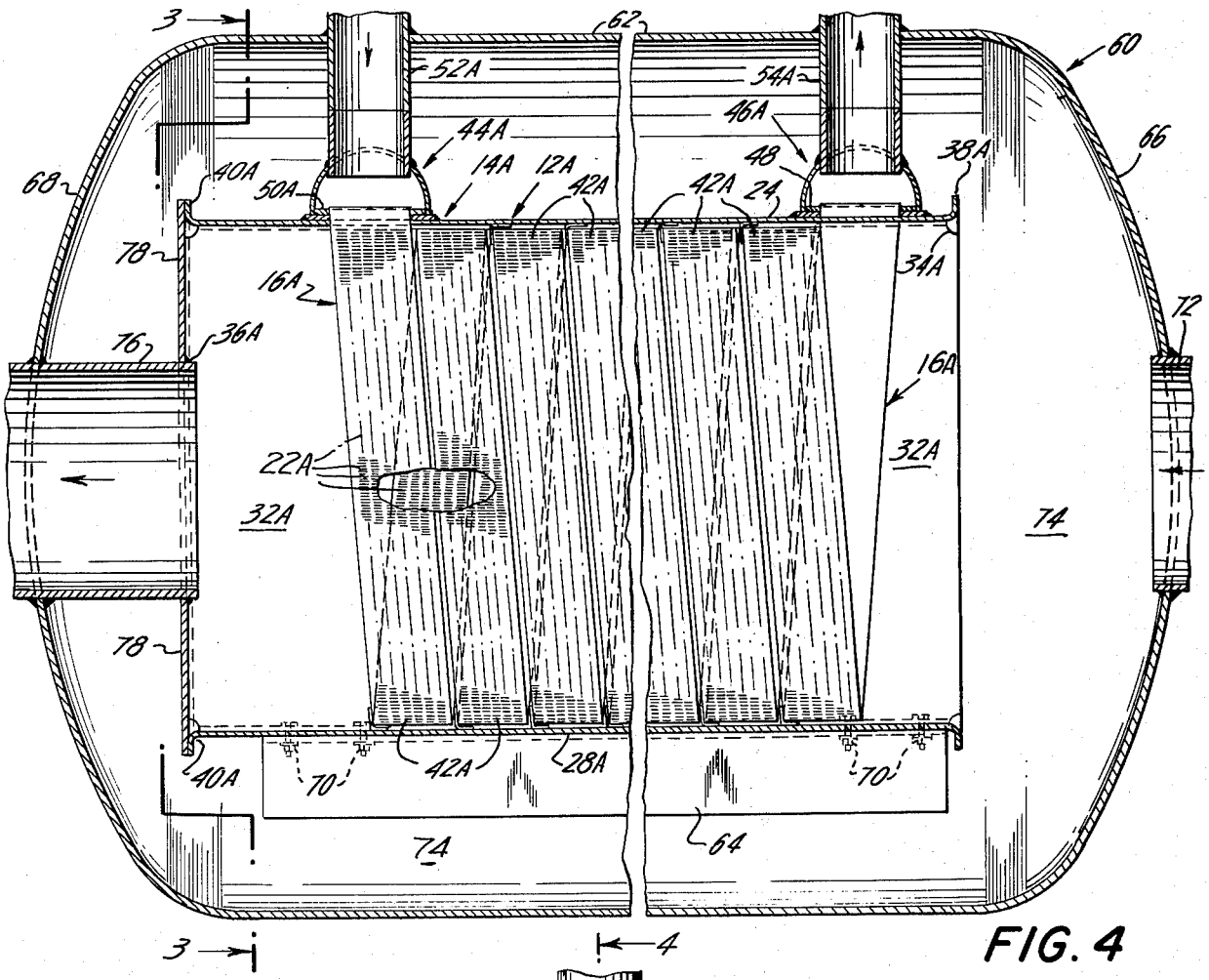
FIG. 4
FIG. 3
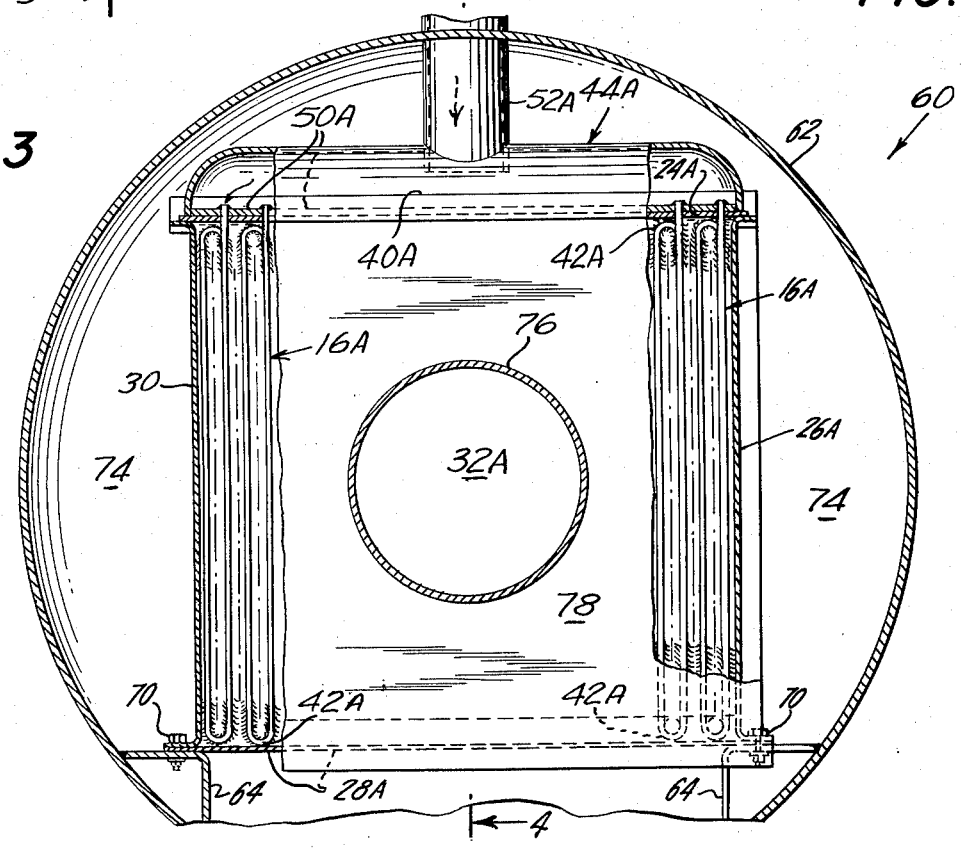

MULTI-PASS HEAT EXCHANGER HAVING FINNED CONDUITS OF POLYGONAL CONFIGURATION IN CROSS-SECTION

This invention relates to heat exchangers of the multi-pass type and, more particularly, to heat exchangers having a plurality of finned tubes to effect indirect heat transfer between two or more fluids.

BACKGROUND OF THE INVENTION

It is desirable in effecting indirect heat exchange between fluids to provide a heat exchange apparatus to effect such heat transfer which is as small as possible in overall size relative to the heat load requirements. Commensurate with this objective, it is common practice to provide heat exchangers having a plurality of tubes wherein each tube comprises a plurality of straight tube portions interconnected by U-bend portions to provide series flow of fluid through the tubes. In the cross-flow type of heat exchanger having serpentine tubes, the fluid flowing externally of the tubes contacts substantially simultaneously all of the straight portions of a tube. One such heat exchanger is disclosed in the U.S. Pat. to O'Connor, No. 3,781,959, dated Jan. 1, 1974 wherein each of the tubes or conduits of rectangular configuration in cross-section are bent about axes parallel to its larger side to form an undulating, ribbon-like configuration in which the conduit lies in a single plane. This configuration, when employed in a heat exchanger, provides as far as a single serpentine conduit is concerned, a two dimensional configuration where the external fluid with respect to the internal fluid makes a single heat transfer pass of the plurality of straight conduit portions. This type heat exchanger is relatively inefficient since a maximum temperature differential between the internal and external fluids is not maintained at each straight conduit portion, which temperature differential is necessary for optimum heat transfer. Obviously, fluid flowing internally of the conduit, at each successive straight conduit portion, will be at a temperature closer to that of the external fluid so that at the last straight conduit portion, relative to internal fluid flow, the differential fluid temperature will be relatively small and thus heat transfer at that straight portion will be relatively small as compared to the first straight portion. The present invention seeks to avoid this problem by providing a three dimensional heat exchanger configuration where the external fluid flows successively past each of the plurality of straight conduit portions (in effect constitute passes) whereby optimum temperature differential at each straight conduit portion or pass is maintained for maximum heat transfer at each straight conduit portion.

It is therefore an object of this invention to provide a multi-pass heat exchanger having at least one finned conduit of polygonal configuration in cross-section which has an overall small size relative to the heat transfer load requirements and which effects such transfer efficiently.

It is another object of the present invention to provide a multi-pass heat exchanger in which the number of tube joints and external manifolds is substantially less than heretofore known multi-pass heat exchangers.

A further object of this invention is to provide heat exchange modules which are capable of assembly for either low or high fluid pressure use and in which the possibility of leakage is minimal.

SUMMARY OF THE INVENTION

Accordingly, the present invention contemplates a multi-pass heat exchanger comprising a casing or shell within which is disposed a tube bank consisting of at least one conduit of polygonal configuration in cross-section, preferably being a rectangular configuration in cross-section having two opposite large sized surfaces and having two opposite small sized surfaces. The shell has a first inlet opening and a first outlet opening to respectively receive a first fluid and pass this fluid from the heat exchanger to waste, storage or place of use, after passing over the tube bank. The tube bank is connected to receive a second fluid from a source thereof and to pass the second fluid from the tube bank after passing in indirect heat transfer relationship with the first fluid flowing through the shell.

The conduit of the tube bank is provided with a plurality of spaced parallel extended surface elements connected to each of the large sized surfaces of the conduit. The conduit is also formed to have a flattened helical configuration consisting of substantially straight portions so arranged that alternate straight portions extend in substantial parallelism, and U-bend or return bend portions interconnecting end-to-end next adjacent straight portions so that series flow of the second fluid is provided through the straight portions.

The conduit of the tube bank is positioned in the shell between the first inlet and outlet openings with the small sized surfaces of each conduit extending in planes generally normal to the longitudinal axis of the shell so that the first fluid flows past the exterior surfaces of the conduit and in indirect heat transfer with the second fluid flow through the interior of the conduit.

In a narrower aspect of the invention, the tube bank comprises a plurality of conduits disposed within the shell in side-by-side relationship, an inlet header, and an outlet header. The inlet and outlet headers may be disposed exteriorly of the shell with the end portions of each of the conduits extending through the wall of the shell and connecting with the headers.

In another embodiment of the invention where the first fluid is of high pressure, the shell, tube bank aand headers as a unitary assembly, are disposed in a vessel with an inlet and outlet conduit extending through the wall of the vessel and connected, respectively, to the inlet header to pass second fluid thereto and the outlet header to pass the second fluid from the latter. Suitable passageway means in the wall of the vessel is provided to conduct the first fluid to and from the shell and the interior of the vessel. In this heat exchanger, since the first fluid is adjacent opposite sides of the walls of the shell, the pressure differential across those walls is negligible.

In a still further embodiment of the present invention, two sets of tube banks for conducting a second and a third fluid, may be disposed within the shell so that the first fluid passes in indirect heat transfer with the second and third fluids. It is within the scope of this embodiment to position the tube banks within the shell such that the first fluid contacts the tube banks successively or concurrently.

BRIEF DESCRIPTION OF THE DRAWING

The invention will be more clearly understood from the following detailed description thereof when considered in connection with the accompanying drawings wherein several embodiments of the invention are illustrated by way of example and in which:

FIG. 3 is a transverse cross-sectional view of a heat exchanger according to a second embodiment of this invention taken along line 3—3 of FIG. 4;

FIG. 4 is a longitudinal view in cross-section taken along line 4—4 of FIG. 3;

DESCRIPTION OF PREFERRED EMBODIMENTS

Figure 1:
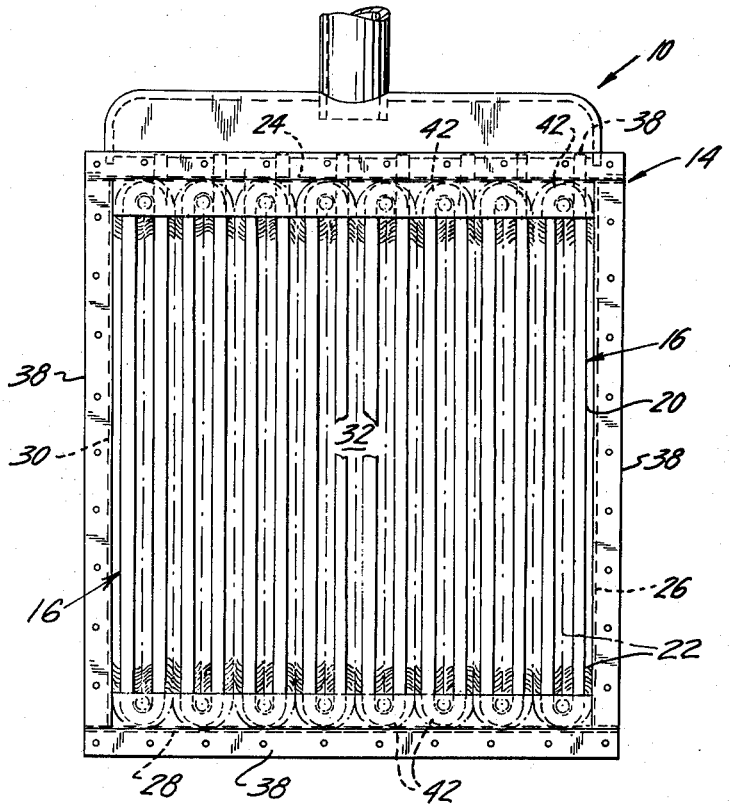
FIG. 1 is an end elevational view of the heat exchanger according to a first embodiment of the invention.
Figure 2:
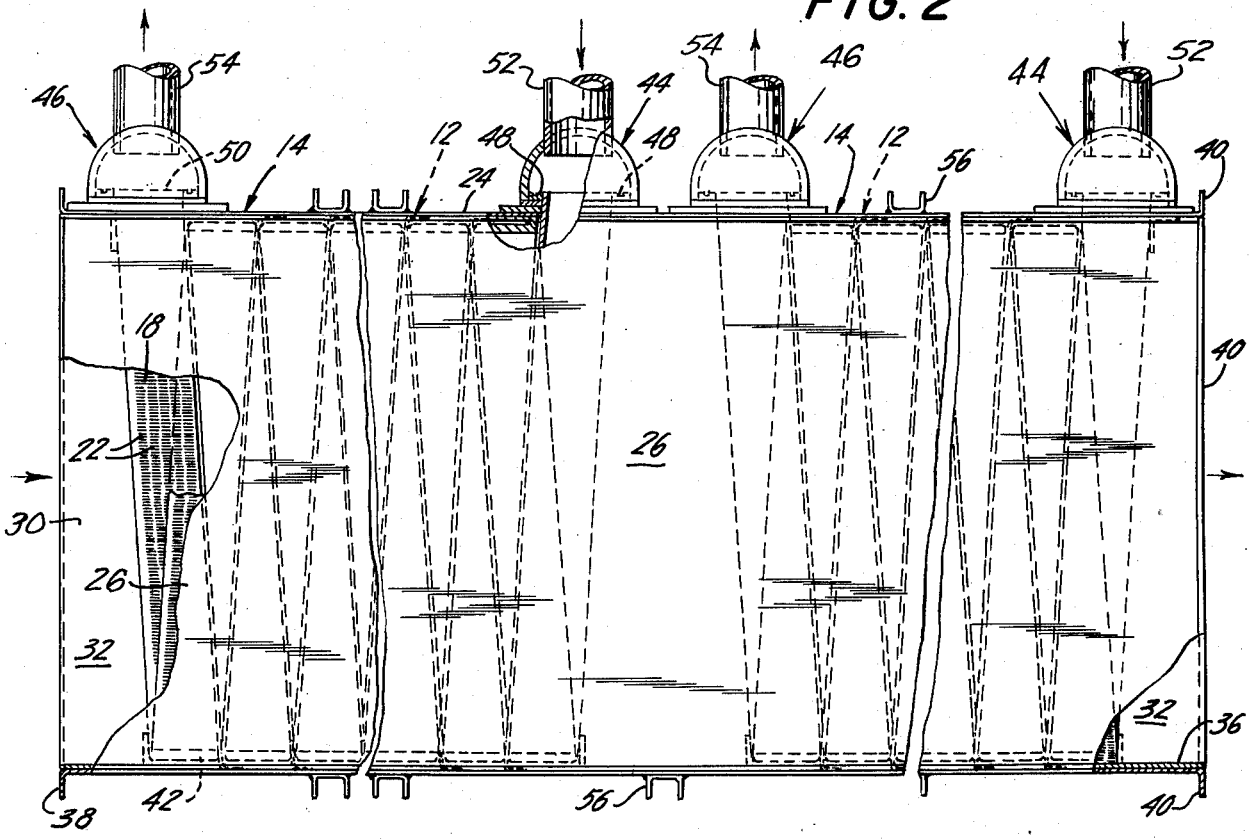
FIG. 2 is a side elevational view of the heat exchanger shown in FIG. 1 with parts broken away for illustration purposes only.

Now referring to the drawings and, more particularly, to FIGS. 1 and 2, the reference number 10 generally designates a multi-pass heat exchanger according to a first embodiment of this invention. The heat exchanger 10 comprises essentially, at least, one or more tube banks 12 disposed in a casing or shell 14. Since both tube banks 12 shown in FIG. 1 are identical to each other, only one will be described in detail.

Each of the tube banks 12 comprises a plurality of conduits 16 of the type having a polygonal configuration in cross-section, preferably having (as shown) a rectangular shape in cross-section and therefore having opposite surfaces 18 of large size and opposite surfaces 20 of small size. Each of the conduits 16 have extended surface elements or fins 22 which are integrally formed by skiving as disclosed in the U.S. Pat. Nos. to Kritzer, 3,202,212, dated Aug. 24, 1965, and Pasternak, 3,746,086, dated July 17, 1973, or, if separate elements, connected to surfaces 18 by brazing, soldering, welding or by some other suitable method. The conduits 16 may be of the single or multi-port type as are disclosed in the U.S. Pat. to O'Connor, No. 3,692,105, dated Sept. 19, 1972.

The shell 14 comprises four contiguous walls 24, 26, 28 and 30 which may be of plates or sheet metal suitably secured together along their adjacent edge portions to form an enclosure or chamber 32 which is open at opposite ends. The open end of the chamber 32, to the left as viewed in FIG. 2, may be a fluid inlet opening 34 while the open end to the right, as viewed in FIG. 2, may be a fluid outlet opening 36. The end portions of each of the walls adjacent inlet and outlet openings 34 and 36 are provided with flanges 38 and 40. The flanges 38 serve to connect shell 14 to a supply duct (not shown) for conducting a first fluid, such as air or waste gas, from a suitable source (not shown) to inlet opening 34, while flanges 40 permit a discharge duct (not shown) to be connected to the shell at the outlet opening 36 to conduct the first fluid, after heat transfer with a second fluid flowing through conduits 16, to atmosphere, storage or place of use (not shown).

Figure 8:
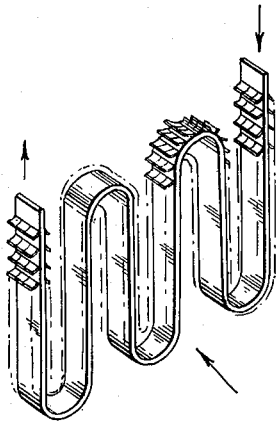
FIG. 8 PRIOR ART
FIG. 8 is a schematic perspective view of a heat exchange conduit of the prior art with the conduit expanded or stretched for illustration purposes.
Figure 9:
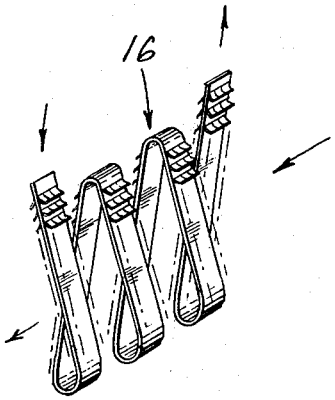
FIG. 9 is a schematic perspective view of the heat exchange conduit according to this invention with the conduit expanded solely to better illustrate the flattened helical configuration.

As schematically illustrated in FIG. 9, each of the conduits 16 is formed into a flattened helical configuration consisting of a plurality of substantially straight portions interconnected, end-to-end, by integral return bends or U-bend portions 42. The pitch of the helix is small so that the portions of the longitudinal axes of conduits 16 are slightly canted relative to the longitudinal axis of shell 14. The straight portions are so arranged that alternate straight portions extend in substantial parallelism with each other and have U-bends 42 interconnecting, end-to-end, next adjacent straight portions so that series flow of the second fluid is provided through the straight portions. This flattened helical configuration of conduits 16 is to be distinguished from the undulating ribbon-like configuration of the heat transfer conduits of the prior art which is illustrated in FIG. 8 and disclosed in the patent to O'Connor, U.S. Pat. No. 3,781,959, dated Jan. 1, 1974. Each of the conduits 16, at the return bends 42, may be supported within shell 14 by a plurality of spaced brackets 43 which are secured to shell walls 24 and 28. The brackets 43 function to lend rigidity to the assembly and the desired relationship of straight portions to each other.

Each of the conduits 16 is positioned in shell 14 with the small sized surfaces 20 extending in planes generally normal to the longitudinal axis of shell 14, while the large sized surfaces 18 extend in planes substantially parallel to the longitudinal axis of the shell. As best shown in FIG. 1, conduits 16 are disposed in close, side-by-side, relationship with the fins 22 of next adjacent conduits being in contact or in very close spaced relationship to each other. The conduits 16 are preferably so dimensioned in relation to the size of chamber 32 that the conduits extend the full distance between the inner surfaces of walls 24 and 28, and fully occupy the space between walls 26 and 30 of shell 14.

To communicate each of the conduits 16 with a source of second fluid, such as steam, refrigerant or other gaseous or liquid fluid, and to conduct the second fluid to a place of use or storage after passing in direct heat transfer with the first fluid passing through chamber 32, an inlet header 44 and an outlet header 46 is provided. As shown, headers 44 and 46 may be located exteriorly of shell 14 and, more specifically, may be secured to the outer surface of wall 24 of shell 14. To provide communication between the inlet header 44 and conduits 16, each of their adjacent end portions extend through wall 24 and a tube sheet 48 forming part of inlet header 44. The end portions of conduits 16 are secured in tube sheet 48 in any suitable fluid tight manner, such as by soldering, brazing, welding or the like. Similarly, the adjacent opposite end portions of conduits 16 extend through wall 24 and a tube sheet 50 of outlet header 46, the end portions being secured in the tube sheet in a fluid tight manner. To communicate inlet header 46 with a source of second fluid (not shown), a supply pipe or conduit 52 is connected at one end to inlet header 44. Similarly, a discharge pipe or conduit 54 is connected at one end to outlet header 46 to communicate the latter with a place of use or storage of the second fluid (not shown).

The shell 14 may be reinforced to withstand the fluid pressure within chamber 32 and to give the assembly increased rigidity by any suitable means, such as spaced braces 56 which may be (as shown) U-shaped channels.

In operation of heat exchanger 10, a first fluid is passed into chamber 32, via inlet opening 34, while a second fluid is conducted through inlet header 44 to and through conduits 16 to outlet header 46. The first fluid flowing through chamber 32 and the second fluid flowing through conduits 16, exchange heat through the walls of conduits 16 with either heated or cooled first fluid passing out of outlet opening 36 and either cooled or heated second fluid passing through discharge conduit 54. Also, the first fluid, after passing in heat transfer relationship with the second fluid, flows into heat transfer relationship withh a third fluid flowing through a second tube bank 12 comprising conduits identical to conduits 16.

Obviously, without departure from the scope and spirit of this invention, the flow through inlet header 44 and outlet header 46 may be reversed so that the direction of flow of the first and second fluids is concurrent rather than counter-current. Likewise, the inlet and outlet headers of the other tube bank may be arranged to provide either concurrent or counter-current flow between the first and third fluids. In addition, the inlet and outlet headers may be located adjacent wall 28 of shell 14 or one adjacent wall 24 and one adjacent wall 28 without departing from the scope and spirit of this invention.

In FIGS. 3 and 4 is shown a heat exchanger 60 according to a second embodiment of this invention, which embodiment differs from heat exchanger 10 principally in that the entire heat exchange assembly is disposed in a closed pressure vessel 62. The heat exchanger 60 has utility where the pressure of the first fluid creates a pressure differential across the shell walls which is beyond the structural strength of the shell. The parts of heat exchanger 10 will be designated by the same reference number with a suffix A added thereto.

The heat exchanger 60 comprises a single tube bank 12A located in a shell 14A. The tube bank 12A has conduits 16A which are identical to the conduits 16 of tube bank 12. The conduits 16A are connected at their opposite adjacent end portions to receive a second fluid from a source thereof (not shown) through a supply conduit 62A and an inlet header 44A and to pass the second fluid, after heat transfer with the first fluid, to a place of use or storage via an outlet header 46A and a discharge conduit 54A. The supply conduit 52A and discharge conduit 54A extend through the wall of vessel 62 and are secured in a fluid-tight manner to the vessel wall in any suitable manner which may be by welding, soldering or brazing. The tube bank and shell assembly are supported in vessel 62 on a pair of brackets 64 so that inlet opening 34AA and outlet opening 36A of shell 14A are spaced from the adjacent end walls 66 aand 68 of vessel 62. The tube bank and shell assembly may be secured to brackets 64 by a plurality of bolts 70 extending through holes in the flanged bottom end of walls 26A and 30A of shell 14A.

The vessel 62 is provided with an inlet pipe or duct 72 which is secured in end wall 66 and is connected to a source of first fluid (not shown) to conduct the first fluid into the interior 74 of vessel 62. The opposite end of vessel 62 is provided with an outlet pipe or duct 76 which is secured in end wall 68 and extends inwardly to outlet opening 36A where it is secured by suitable means such as welding, brazing or soldering. The outlet opening 36A is located in an end plate 78 which is secured to flanges 40A of shell walls 24A, 26A, 28A and 30A.

In operation of heat exchanger 60, a second fluid flows through each of the conduits 16A, via supply conduit 52A and discharge conduit 54A, and in indirect heat transfer with the first fluid flowing through shell 14A by way of inlet duct 72, interior 74 of vessel 62, chamber 32A and outlet duct 76. The first fluid which enters interior 74 of vessel 62 fills the interior 74 so that substantially the same fluid pressure is adjacent the exterior of shell 14A as is in chamber 32A so that the pressure differential across each of the walls 24A, 26A, 28A and 38A of shell 14A is negligible. Since vessel 62 is cylindrical, it is capable of withstanding the relatively high pressure differential across its walls.

Figure 5:
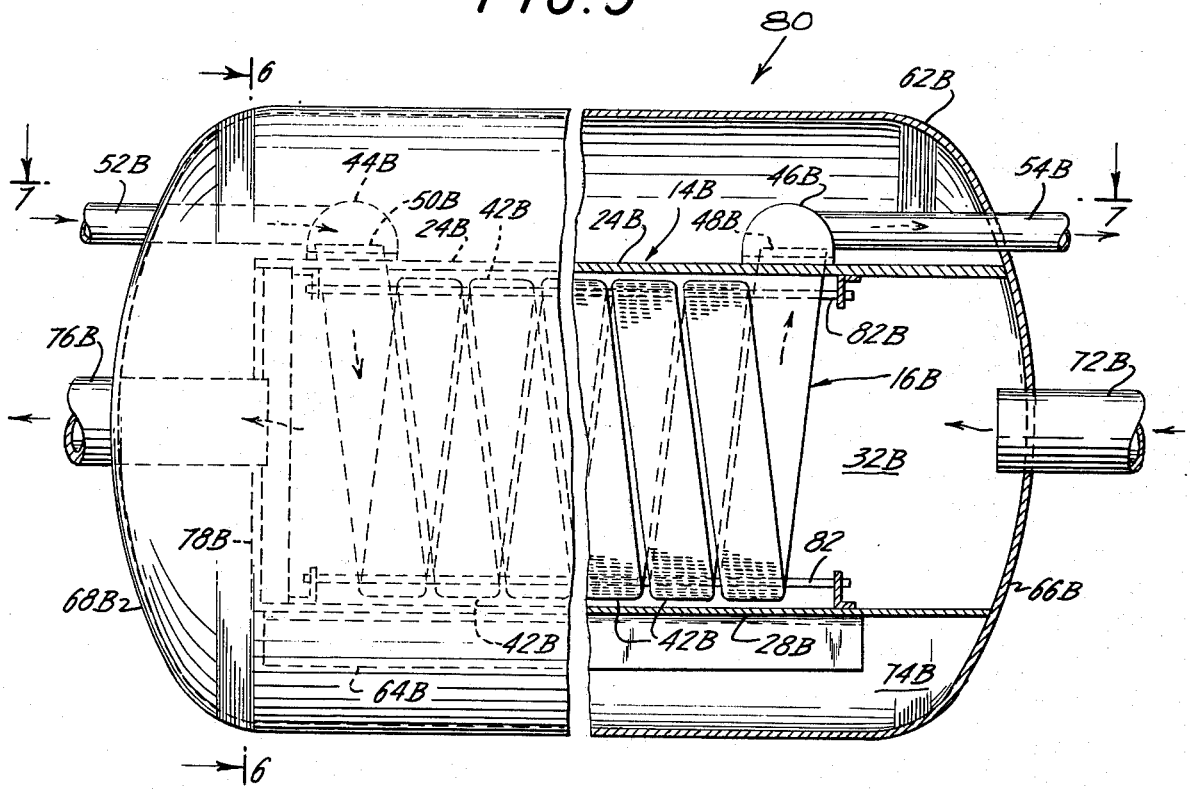
FIG. 5 is a side elevational view partly in cross-section of a heat exchanger according to a third embodiment of this invention.
Figure 6:
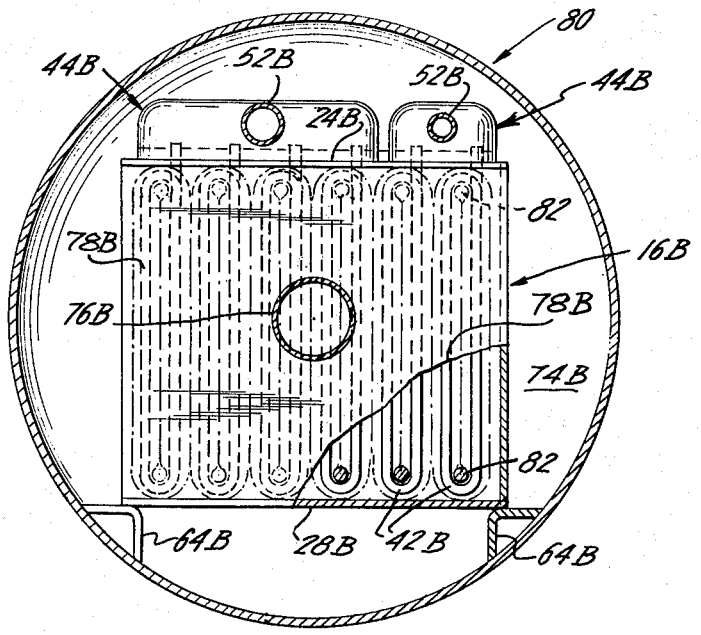
FIG. 6 is a cross-sectional view taken along line 6—6 of FIG. 5.
Figure 7:
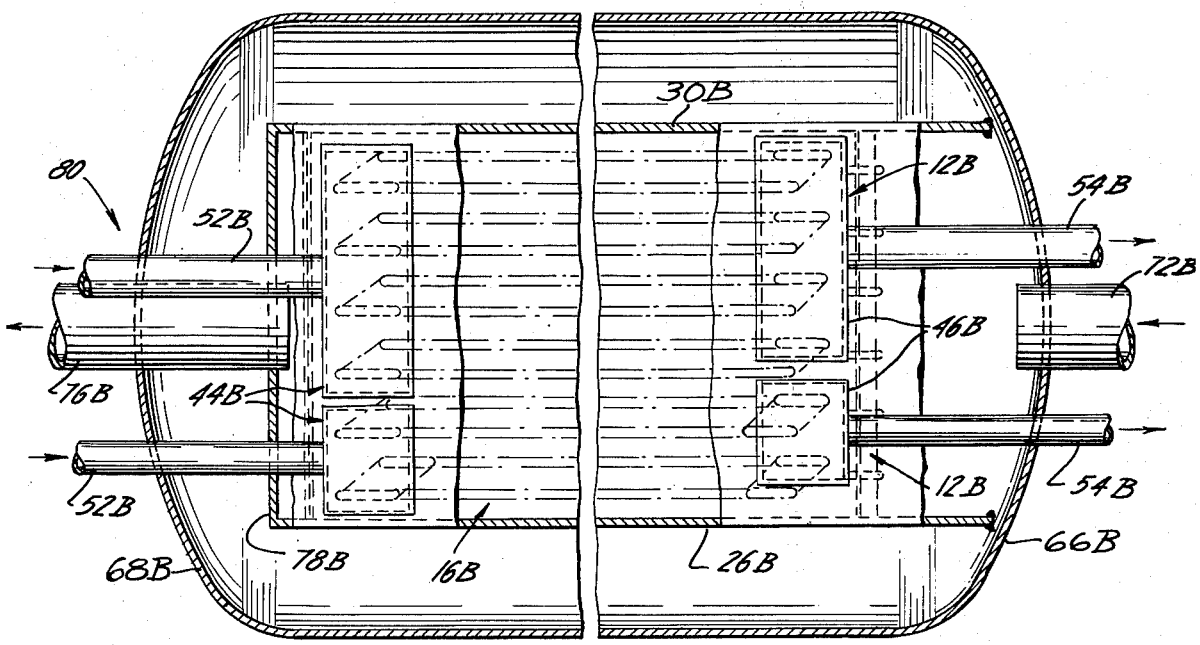
FIG. 7 is a view in cross-section taken substantially along line 7—7 of FIG. 5.

In FIGS. 5, 6 and 7 is shown a heat exchanger 80 according to a third embodiment of this invention, which embodiment is similar to heat exchanger 60 shown in FIGS. 3 and 4 in that the tube bank and shell assembly is disposed in a closed vessel. The heat exchanger 80 essentially differs from heat exchanger 10 shown in FIGS. 1 and 2 in that the two tube banks are arranged, relative to fluid flow through the shell, in parallel rather than in sequential relationship relative to first fluid flow as in heat exchanger 10. Also, the conduits of heat exchanger 80 are wrapped about spaced parallel rods for support instead of spaced brackets 43 of heat exchanger 10. Parts of heat exchanger 80 corresponding to like parts of heat exchangers 10 and 60 will be designated by the same reference number with the suffix B added thereto.

The heat exchanger 80 has a shell 14B, the walls of which are extended to and are connected to end wall 66B of vessel 62B so that chamber 32B of shell 14B is isolated from the interior 74B of vessel 62B. This then permits, if desired, interior 74B to be evacuated or pressurized by a fluid other than the first fluid flowing through chamber 32B.

Another feature of heat exchanger 80 is the provision of rods 82 which extend adjacent U-bend portions 42B of conduits 16B and are supported on walls 24B and 28B of shell 14B. The pair of rods 82 for each conduit 16B lends rigidity to the assembly. The operation of heat exchanger 80 is similar to that described with respect to heat exchanger 60, except that, as described for heat exchanger 10, the first fluid flowing through chamber 32B passes in indirect heat transfer simultaneously with a second and third fluid flowing through the two tube banks 12B.

Obviously, in each of the heat exchangers 60 and 80, without departure from the scope and spirit of this invention, the inlet and outlet headers relative to the inlet and outlet ducts may be changed to provide, instead of counter-flow of fluids as is shown, concurrent flow of fluids.

It is believed now readily apparent that the present invention provides a multi-pass heat exchanger having finned heat transfer conduits of polygonal shape in cross-section, which heat exchanger has a high heat transfer capacity in relation to its overall size.

It is a heat exchanger, in an application where the fluids flow counter to each other, which provides for optimum heat transfer. It is a heat exchanger which is particularly suitable for effecting heat transfer between a gaseous fluid and a liquid.

Although several embodiments of the invention have been illustrated and described in detail, it is to be expressly understood that the invention is not limited thereto. Various changes can be made in the arrangement of parts without departing from the spirit and scope of the invention as the same will now be understood by those skilled in the art.

What is claimed is:

1. A multi-pass heat exchanger comprising:

a. a shell having a first fluid inlet connected to a source of first fluid and an outlet opening connected to pass first fluid from the heat exchanger;

b. at least one tube bank connected to receive a second fluid from a source thereof and connected to pass said second fluid from the tube bank after passing in indirect heat transfer relationship with the first fluid;

c. said tube bank comprising at least one conduit of polygonal configuration in cross-section and having four contiguous surfaces;

d. the conduit being formed into a flattened helical configuration consisting of at least three substantially straight portions so arranged that alternate straight portions extend in substantial parallelism to each other and U-bend portions interconnecting next adjacent straight portions for series flow of a second fluid therethrough and to provide at least three passes in indirect heat exchange with said first fluid; and e. said tube bank being disposed in said shell between said inlet and outlet openings so that the first fluid successively passess said straight portions of the conduit and to thereby effect heat transfer between said first and second fluids.

2. The apparatus of claim 1 wherein an inlet header and an outlet header are provided and wherein said tube bank comprises a plurality of said conduits disposed adjacent each other in said shell and with their opposite adjacent end portions being connected to the inlet header and outlet header.

3. The apparatus of claim 2 wherein said inlet header and outlet header are located exteriorly of the shell and wherein said opposite adjacent end portions extend through the wall of said shell.

4. The apparatus of claim 1 wherein said conduit is provided with a plurality of extended surface elements projecting from two opposite surfaces of the conduit.

5. The apparatus of claim 1 wherein each of said conduits is rectangular in cross-section and has two opposite large sized surfaces and two opposite small sized surfaces, wherein extended surface elements extend from the two opposite large sized surfaces, and wherein each conduit is disposed in the shell with the large sized surfaces lying in planes substantially parallel to the direction of first fluid flow through said shell.

6. The apparatus of claim 1 wherein said tube bank comprises a second tube bank disposed in said shell and wherein said conduit of the second tube bank is connected to receive a third fluid and conduct the same in indirect heat transfer with said first fluid.

7. The apparatus of claim 6 wherein said tube bank and said second tube bank are disposed relative to each other to be successively contacted by said first fluid.

8. The apparatus of claim 6 wherein said tube bank and said second tube bank are disposed in parallel to concurrently be contacted by said first fluid.

9. A multi-pass heat exchanger comprising:

a. a shell having a first inlet opening and a first outlet opening to respectively receive a first fluid and pass said first fluid from the heat exchanger;

b. at least one tube bank disposed in said shell;

c. said tube bank consisting of a plurality of conduits disposed in side-by-side relationship to each other;

d. each of said conduits having a rectangular shape in cross-section and having contiguous surfaces consisting of two opposite large sized surfaces and two opposite small sized surfaces;

e. a plurality of spaced, parallel fins extending from each of the large sized surfaces of each of said conduits;

f. each of the conduits being formed into a flattened helical configuration consisting of at least three substantially straight portions so arranged that alternate straight portions extend in substantial parallelism with each other and U-bend portions interconnecting next adjacent straight portions so as to provide series flow of a second fluid therethrough and at least three passes in indirect heat exchange with said first fluid flowing exteriorly of the conduit;

g. inlet header and outlet header;

h. each of said conduits having their opposite end portions connected to communicate with said inlet and outlet headers to provide for flow of a second fluid through each of said conduits; and i. each of said conduits being disposed in said shell between said first inlet and outlet openings with the small sized surfaces of the conduits lying in planes generally normal to the direction of first fluid flow so that the first fluid successively passes the straight portions of said conduits.

10. The heat exchanger of claim 9 wherein said inlet header and said outlet header are located adjacent the exterior of said shell.

11. The heat exchanger of claim 9 wherein said fins are formed in spaced rows with each row extending transversely of its associated large sized surface.

12. The heat exchanger of claim 9 wherein said tube bank includes a second tube bank having a plurality of conduits connected to receive a third fluid from a source thereof and conduct the same in indirect heat transfer with said first fluid.

13. The heat exchanger of claim 9 wherein said tube bank and said second tube bank are positioned relative to each other in said shell to provide for successive contact of the first fluid flowing through the shell.

14. The heat exchanger of claim 9 wherein said tube bank and said second tube bank are positioned relative to each other in said shell to provide for concurrent contact of the first fluid flowing through the shell.

15. The heat exchanger of claim 9 wherein said shell has four contiguous walls forming a four sided polygon open at both ends.

* * * * *

UNITED STATES PATENT OFFICE
CERTIFICATE OF CORRECTION

PATENT NO. : 3,991,823
DATED : November 16, 1976
INVENTOR(S) : William R. Litke - Richard J. Haberski It is certified that error appears in the above-identified patent and that said Letters Patent are hereby corrected as shown below:

In Fig. 3 reference number "30" should read -- 30A --.

In Fig. 5 reference number "82B" should read -- 82 --.

Column 4, line 58, correct number "46" to read -- 44 --.

Column 5, line 46, "62A" should read -- 52A --.

Column 6, line 14, number "38A" should read -- 30A --.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*